US005120205A

United States Patent [19]

Ban et al.

[11] Patent Number: 5,120,205

[45] Date of Patent: Jun. 9, 1992

[54] SCROLL TYPE COMPRESSOR WITH IMPROVED BEARING ARRANGEMENT FOR DRIVE SHAFT

[75] Inventors: Takashi Ban; Tetsuhiko Fukanuma; Tatsushi Mori, all of Kariya, Japan

[73] Assignee: Kabushiki Kaisha Toyoda Jidoshokki Seisakusho, Kariya, Japan

[21] Appl. No.: 637,158

[22] Filed: Jan. 3, 1991

[30] Foreign Application Priority Data

Jan. 11, 1990 [JP] Japan ..... 2-2241[U]

[51] Int. Cl.[5] ..... F04C 18/04; F04C 29/02

[52] U.S. Cl. ..... 418/55.1; 418/55.6; 418/100

[58] Field of Search ..... 418/55.1, 55.3, 55.6, 418/100; 384/490, 504

[56] References Cited

U.S. PATENT DOCUMENTS 2,792,764 5/1957 Carlsen et al. ..... 384/504
4,456,435 6/1984 Hiraga et al. ..... 418/55.1
4,484,869 11/1984 Nakayama et al. ..... 418/55.6
4,798,523 1/1989 Glaser et al. ..... 384/504

FOREIGN PATENT DOCUMENTS

Ad.64695 6/1955 France ..... 384/490
60-101295 6/1985 Japan .
60-233389 11/1985 Japan .

*Primary Examiner*—John J. Vrablik
*Attorney, Agent, or Firm*—Brooks Haidt Haffner & Delahunty

[57] ABSTRACT

In a scroll type compressor, a movable scroll is engaged with an immovable scroll so that spaces are formed for taking in a fluid to be compressed. The movable scroll is revolved around a central axis of the immovable scroll, so that the spaces are displaced toward the centers of the walls while a volume thereof is reduced to compress the fluid therein. The revolution of the movable scroll is converted from a rotation of a drive shaft through an eccentric mechanism provided therebetween. The shaft is rotatably supported by first and second angular bearings, which are spaced apart from each other along a longitudinal axis of the shaft and are far from and adjacent to the eccentric mechanism, respectively. The first and second bearings are correlatively oriented, and thus an increase of a load to which the second bearing is subjected due to a force exerted upon the shaft in a cantilever manner during a compression operation is suppressed.

4 Claims, 3 Drawing Sheets

SCROLL TYPE COMPRESSOR WITH IMPROVED BEARING ARRANGEMENT FOR DRIVE SHAFT

BACKGROUND OF THE INVENTION

1) Field of the Invention

The present invention relates to a scroll type compressor which can be used, for example, in an air-conditioning system of a vehicle such as an automobile, and more particularly, to a scroll type compressor provided with an improved bearing arrangement for a drive shaft thereof.

2) Description of the Related Art

A scroll type compressor is well known as a compressor for an air conditioning system of an automobile, and comprises immovable and movable scroll members housed in a housing and having spiral guide walls engaged with each other in such a manner that spaces are formed therebetween. The movable scroll member is revolved around a center axis of the immovable scroll member in such a manner that the engagement is maintained between the spiral guide walls of the immovable and movable scroll member, and that the spaces therebetween are displaced toward centers of the spiral guide walls. During the revolution of the movable scroll member around the center axis of the immovable scroll member, a space appears successively at the outsidemost portions of the spiral guide walls thereof, and opens to take in a refrigerant, including a lubricating oil mist, fed from an evaporator of the air conditioning system, and then the space concerned is fully closed by the spiral guide walls due to the revolution of the movable scroll member. Thereafter, as the space concerned is displaced toward the centers of the spiral guide walls, a volume thereof becomes gradually smaller, whereby the refrigerant confined therein is compressed, and when the space concerned reaches the centers of the spiral guide walls, the compressed refrigerant is discharged into a discharge chamber formed in the housing of the compressor. Thereafter, the space concerned disappears at the centers of the spiral guide walls, and thus a compression of the refrigerant is successively carried out.

To cause the revolution of the movable scroll member around the central axis of the immovable scroll member, the compressor further comprises a drive shaft operatively connected to and rotated by a prime motor of the vehicle, and an eccentric mechanism provided between the drive shaft and the movable scroll member for converting the rotation of the drive shaft into the revolution of the movable scroll member. During the revolution of the movable scroll member, i.e., the compression of the refrigerant, a large force resulting from the compressed refrigerant is exerted upon the drive shaft in a cantilever manner, and accordingly, the drive shaft must be rotatably supported by at least two radial bearings spaced apart from each other along a longitudinal axis thereof. In this case, the smaller the distance between the two radial bearings, the larger the load to which the radial bearing adjacent to the eccentric mechanism is subjected, due to the force exerted upon the drive shaft, and thus the service life of the radial bearing adjacent to the eccentric mechanism is greatly shortened. By increasing the distance between the two radial bearings, the load to which the radial bearing adjacent to the eccentric mechanism is subjected can be reduced, whereby the service life of the bearing can be prolonged, but the size of the compressor is increased due to the larger distance between the two radial bearings.

Japanese Unexamined Patent publication No. 60-101295 discloses an arrangement wherein a seal assembly for the drive shaft is disposed between the two radial bearings, so that the distance therebetween can be increased without increasing the size of the compressor, but this arrangement is not completely satisfactory because the bearing disposed at the outside of the seal assembly cannot be lubricated with the oil mist included in the refrigerant; namely, the outer bearing must be lubricated with grease. In this case, a suitable amount of grease must be periodically supplemented to the outer bearing, and dust may be included in the grease applied to the outer bearing, during this supplementing of the grease.

Japanese Unexamined Patent publication No. 60-233389 discloses an arrangement wherein the two radial bearings are disposed at the inside of the seal assembly for the drive shaft. In this arrangement, both bearings can be lubricated with the oil mist included in the refrigerant, but the distance between the two bearings is reduced, and accordingly, the load to which the bearing adjacent to the eccentric mechanism is subjected is increased, resulting in a shortening of the service life thereof. Although a stronger and larger bearing can be used as the bearing adjacent to the eccentric mechanism, this is expensive and the larger size thereof results in an increase of the size of the compressor.

SUMMARY OF THE INVENTION

Therefore, an object of the present invention is to provide a scroll type compressor having an improved bearing arrangement for a drive shaft thereof, by which the above drawbacks are eliminated.

In accordance with the present invention, there is provided a scroll type compressor comprising: a housing; immovable and movable scroll members housed in the housing and having spiral guide walls engaged with each other so that spaces for taking in a fluid to be compressed are formed therebetween, the movable scroll member being revolved around a center axis of the immovable scroll member in such a manner that, as the spaces are displaced toward centers of the spiral guide walls, the volume thereof is reduced to cause compression of the fluid in the spaces; a drive shaft provided in the housing and rotated by a suitable drive source; and an eccentric mechanism provided between the drive shaft and the movable scroll member for converting the rotation of the drive shaft into the revolution of the movable scroll member, wherein first and second angular bearings are provided in the housing for rotatably supporting the drive shaft in such a manner that the first and second angular bearings are spaced apart from each other along a longitudinal axis of the drive shaft, and are far from and adjacent to the eccentric mechanism, respectively; these first and second angular bearings being correlatively oriented so that it is possible to suppress an increase of a load to which the second angular bearing is subjected due to a force exerted upon the shaft in a cantilever manner during a compression operation.

BRIEF DESCRIPTION OF THE DRAWINGS

The objects and advantages of the present invention will be better understood from the following description, with reference to the accompanying drawings, in which.

DESCRIPTION OF THE PREFERRED EMBODIMENTS

Figure 1:
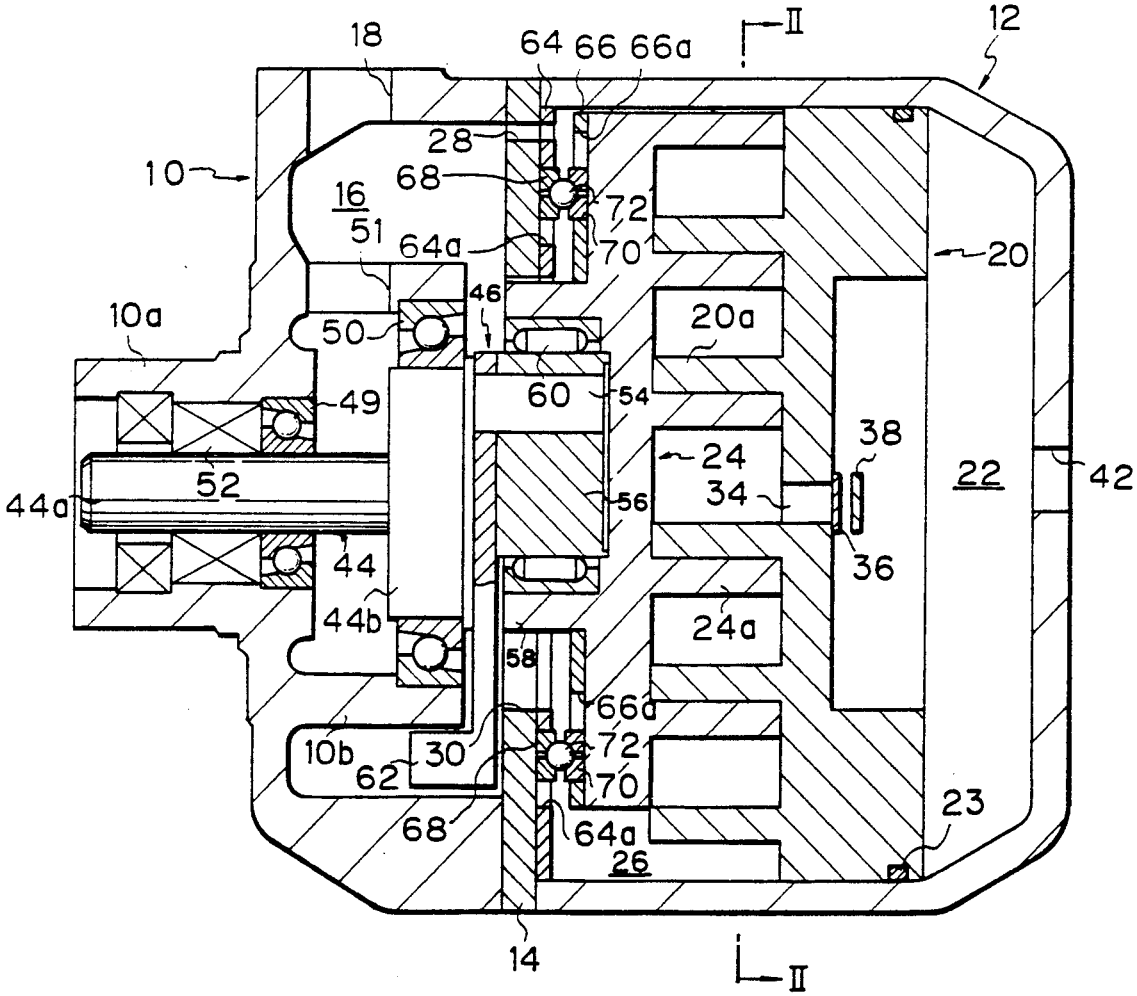
FIG. 1 is a longitudinal sectional view of a scroll type compressor constructed according to the present invention.
Figure 2:
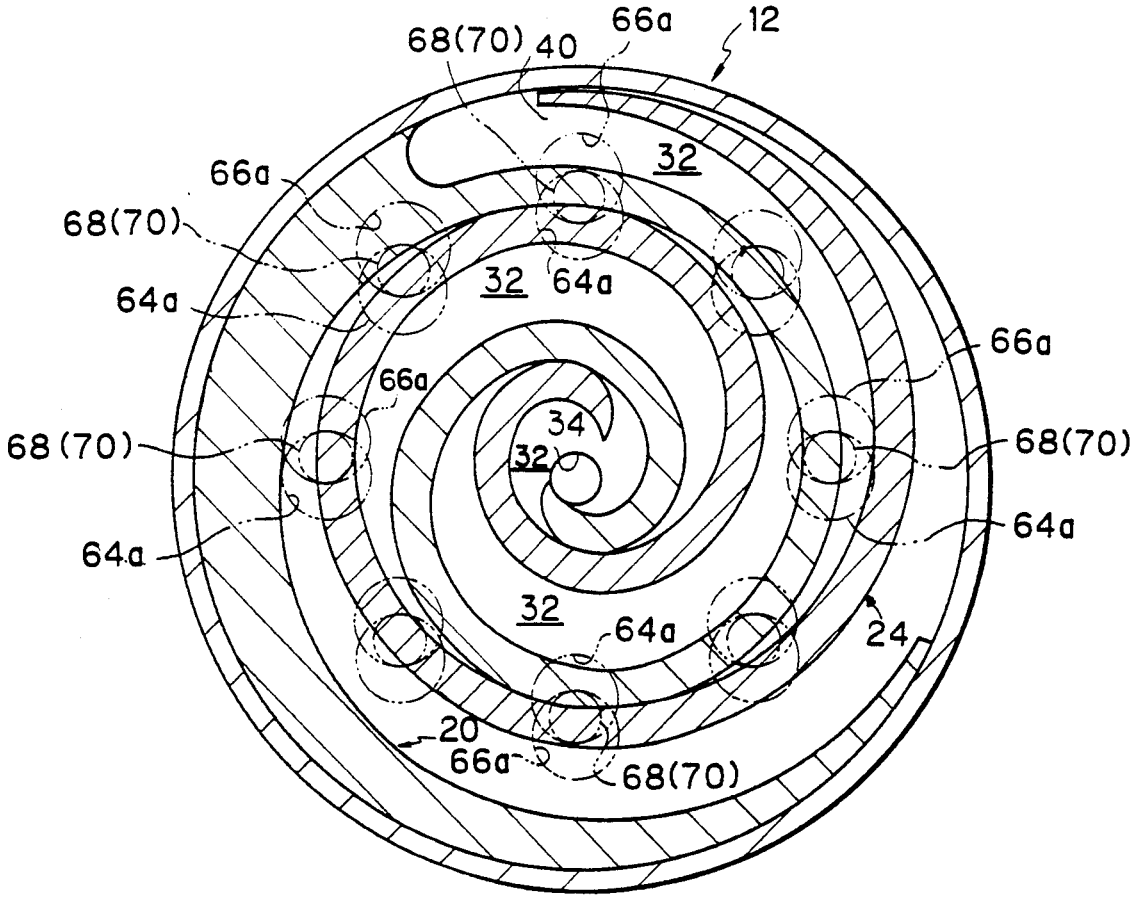
FIG. 2 is a cross-sectional view taken along the line II—II of FIG. 1.

FIGS. 1 and 2 show a scroll type compressor in which the present invention is embodied. This compressor comprises front and rear housings 10 and 12 joined to each other through the intermediary of a disk plate 14. The front housing 10 defines a suction chamber 16 therein, together with the disk plate 14, which is communicated with an evaporator of an air conditioning system (not shown) through an inlet port 18 formed in a side wall of the front housing 10, so that a refrigerant including a lubricating oil mist is introduced from the evaporator into the suction chamber 16 through the inlet port 18.

The compressor also comprises an immovable scroll member 20 received and fixed in the rear housing 12 so that a discharge chamber 22 is defined between the immovable scroll member 20 and an end wall of the rear housing 12, as shown in FIG. 1. Note, reference numeral 23 indicates an annular seal ring disposed in an annular groove formed in a peripheral wall of the immovable scroll member 20. The compressor further comprises a movable scroll member 24 received in an intermediate chamber 26 defined between the disk plate 14 and the immovable member 20 and in communication with the suction chamber 16 through a through hole 28 and a central opening 30 formed in the disk plate 14. As apparent from FIGS., 1 and 2, the immovable and movable scroll members 20 and 24 have spiral guide walls 20*a* and 24*a*, respectively, which are engaged with each other so that spaces 32 are formed therebetween. The immovable scroll member 20 has a through hole 34 formed at the center thereof, so that the discharge chamber can be communicated with a spiral passage defined by the spiral guide wall 20*a*. Note, the through hole 34 is usually closed by a reed valve 36 attached to the rear side wall of the immovable scroll member 20. Further note, reference numeral 38 indicates a retainer for the reed valve 36.

The movable scroll member 24 is revolved around a central axis of the immovable scroll member 20 in the clockwise direction (FIG. 2) in such a manner that the engagement is maintained between the spiral guide walls 20*a* and 24*a*, whereby the spaces 32 are displaced toward the centers thereof. Each of the spaces 32 initially appears at the outsidemost portions of the spiral guide walls 20*a* and 24*a* and opens to the intermediate chamber 26, as indicated by reference numeral 40 in FIG. 2, so that the refrigerant is introduced thereinto, and then the space 32 concerned is completely closed by the spiral guide walls 20*a* and 24*a* due to the revolution of the movable scroll member 24. As the space 32 concerned is displaced toward the centers of the spiral guide walls 20*a* and 24*a*, a volume thereof becomes gradually smaller so that the refrigerant confined therein is compressed, and when the space 32 concerned reaches the centers of the spiral guide walls 20*a* and 24*a* it is brought into communication with the through hole 34, so that the reed valve 38 is opened by the compressed refrigerant and the compressed refrigerant is discharged into the discharge chamber 22. Thereafter, the space 38 concerned disappears at the centers of the spiral guide walls 20*a* and 24*a* and a new space appears at the outsidemost portions thereof, whereby a compression of the refrigerant can be successively carried out. Note, reference numeral 42 indicates an outlet port formed in an end wall of the rear housing 10 and connected to a condenser of the air conditioning system.

To cause the revolution of the movable scroll member 24 around the central axis of the immovable scroll member 20, the compressor further comprises a drive shaft 44 operatively connected to and rotated by a prime motor of the vehicle, and an eccentric mechanism 46 provided between the drive shaft 44 and the movable scroll member 24 for converting the rotation of the drive shaft 44 into the revolution of the movable scroll member 24.

The drive shaft 44 includes an elongated bar portion 44*a* and an enlarged portion 44*b* integrated with an inner end thereof, and is disposed within the front housing 10 so that a longitudinal axis thereof is aligned with the central axis of the immovable scroll member 20. In particular, the elongated bar portion 44*a* of the drive shaft 44 is received in an outer sleeve portion 10*a* projected from an outer end wall surface of the front housing 10 and is rotatably supported by a first angular bearing 48 disposed in the outer sleeve portion 10*a*, and the enlarged portion 44*b* thereof is received in an inner sleeve portion 10*b* projected from an inner end wall surface thereof and is rotatably supported by a second angular bearing 50 disposed in the inner sleeve portion 10*b*. The inner sleeve portion 10*b* has a through hole 51 formed therein, through which an interior of the inner sleeve portion 10*b* is communicated with the suction chamber 16 so that the first and second angular bearings 48 and 50 can be satisfactorily lubricated with the oil mist included in the refrigerant. A well-known seal assembly 52 is disposed in the outer sleeve portion 10*a* at the outside of the first angular bearing 48, to prevent any leakage of the refrigerant through the space around the drive shaft 44.

The eccentric mechanism 46 includes an eccentric shaft element 54 integrally projected from an inner end face of the enlarged portion 44*b* of the drive shaft 44, and a bush element 56 rotatably supported by the eccentric shaft element 54. Further, the movable scroll member 24 has a sleeve portion 58 projected therefrom into the central opening 30 of the disk plate 14 and provided with a radial bearing 60 for rotatably receiving the bush element 56, whereby the movable scroll member 24 is rotatably supported by the bush element 56. With this arrangement, the movable scroll member 24 can be revolved around the central axis of the immovable scroll member 20 by the rotation of the drive shaft 44. Note, the eccentric shaft element 54 is provided with a counterweight 62, to ensure that the eccentric mechanism 46 is stably driven.

To carry out a stable revolution of the movable scroll member 24, the compressor further comprises means for constraining the movement of the movable scroll member 24, which includes a first annular plate 64 attached to a rear side wall of the disk plate 14 and having a plurality of circular recesses 64*a* formed therein, and a second annular plate 66 attached to the movable scroll member 24 and facing the first annular plate 64, and having a plurality of circular recesses 66*a* formed therein. As shown by a chain dot line in FIG. 2, the eight circular recesses 64*a* and the eight circular recesses 66*a* are radially disposed so that each of the circular recesses 64*a* partially overlaps the corresponding circular recess 66*a*. The movement-constraining means also includes eight shoe elements 68 slidably received in the circular recesses 64*a*, respectively, eight shoe elements 70 slidably received in the circular recesses 66*a*, respectively, and eight ball elements 72 slidably disposed between and held by the shoe elements 68 and 70, respectively. With this arrangement the movement of the movable scroll member 24 is constrained, and thus it can be stably revolved around the central axis of the immovable scroll member 20. Note, as apparent from FIG. 1, the through hole 28 is extended through the first annular plate 64.

During the revolution of the movable scroll member 24, i.e., the compression of the refrigerant, a large force resulting from the compressed refrigerant is exerted upon the drive shaft 44 in a cantilever manner, and therefore, the drive shaft 44 is rotatably supported by the first and second angular bearings 48 and 50 spaced apart from each other along a longitudinal axis thereof. The smaller the distance between the first and second angular bearings 48 and 50, the larger the load to which the second angular bearing adjacent to the eccentric mechanism 46 is subjected due to the force exerted upon the drive shaft 44. Nevertheless, according to the present invention, the first and second angular bearings 48 and 50 are correlatively oriented, and thus it is possible to suppress an increase of the load on the second angular bearing 50, as discussed with reference to FIGS. 3(*a*) and 3(*b*) below:

First, referring to FIG. 3(*a*) showing a conventional arrangement of radial bearings 74 and 76 corresponding to the bearings 74 and 76, reference symbols F, $f_1$, $f_2$, $l_1$, and $l_2$ are defined as follows:

F: a force exerted upon the eccentric shaft element 54 during the compression of the refrigerant $f_1$: a load or a force to which the bearing 74 is subjected due to the force F $f_2$: a load or a force to which the bearing 76 is subjected due to the force F $l_1$: a distance between centers of the bearings 74 and 76

$l_2$: a distance between the center of the bearing 76 and a location at which the force F acts on the axis of the drive shaft 44

The load $f_2$ to which the bearing 76 adjacent to the eccentric shaft element 54 is subjected is represented by the following formula:

$$_2=(1+l_2/l_1)F$$

As can be seen from this formula, the smaller the distance $l_1$, the larger the load $f_2$ to which the bearing 76 adjacent to the eccentric shaft element 54 is subjected, and accordingly, the shorter the service life thereof.

Figure 3A:
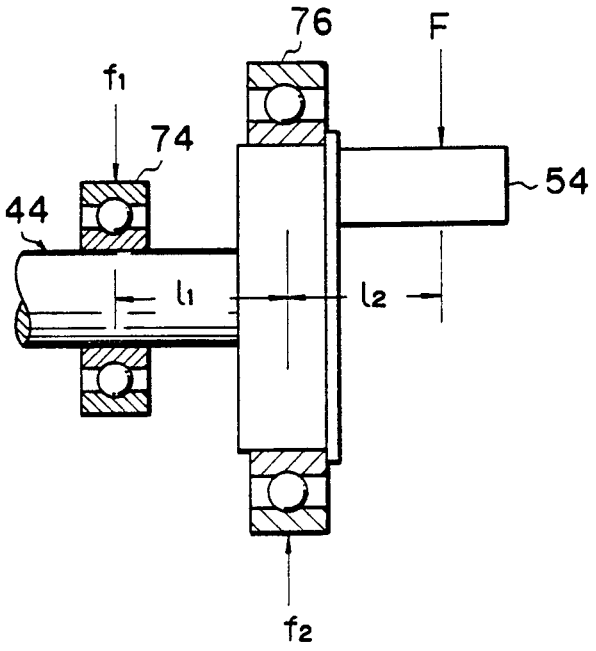
Fig. 3(a) PRIOR ART
FIGS. 3 (*a*) and 3(*b*) are explanatory views for comparing a conventional arrangement of radial bearings with an arrangement of angular bearings according to the present invention.
Figure 3B:
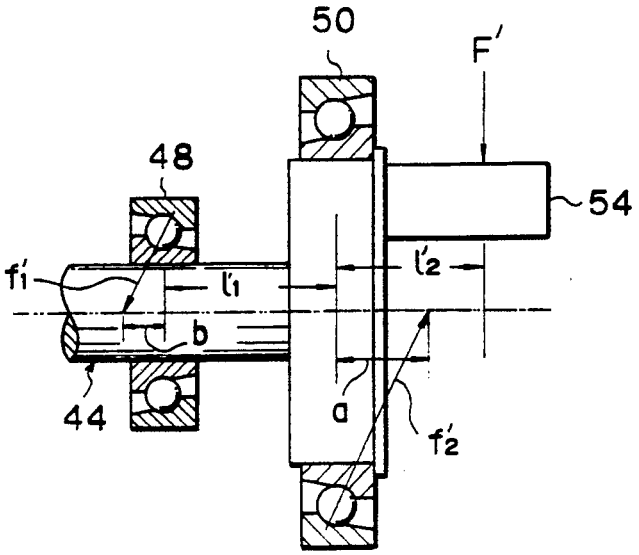

In FIG. 3(*b*) showing the bearing arrangement according to the present invention, reference symbols F', $f_1'$, $f_2'$, $l_1'$, $l_2'$, and "a", and "b" are defined as follows:

F': a force exerted upon the eccentric shaft element 54 during the compression of the refrigerant (F=F')

$f_1'$: a load or a force to which the first angular bearing 48 is subjected due to the force F'

$f_2'$: a load or a force to which the second bearing 50 is subjected due to the force F'

$l_1'$: a distance between centers of the first and second bearings 48 and 50 ($l_1'=l_1$)

$l_2'$: a distance between the center of the second bearing 50 and a location at which the force F' acts on the axis of the drive shaft 44 ($l_2'=l_2$)

"a": a distance between the center of the second bearing 50 and a location at which the force $f_2'$ acts on the axis of the drive shaft 44

"b": a distance between the center of the first bearing 48 and a location at which the force $f_1'$ acts on the axis of the drive shaft 44

The load $f_2'$ to which the second angular bearing 50 is subjected is represented by the following formula:

$$f_2'=[1+(l_2'-a)/(l_1'+b)]F$$

As can be seen from a comparison of this formula with the above-mentioned formula, the load $f_2'$ on the second angular bearing 50 is much smaller than the load $f_2$ to which the bearing 76 is subjected, because the distance ($l_1'+b$) between the center of the second angular bearing 50 and the location at which the force $f_1'$ acts on the axis of the drive shaft 44 is increased by the distance "b", and because the distance ($l_2'-a$) between the center of the second angular bearing 50 and the location at which the force $f_2$ acts on the axis of the drive shaft 44 is shortened by the distance "a".

Therefore, according to the present invention, it is possible to prolong the service life of the second angular bearing 50 adjacent to the eccentric mechanism 46, and further, not only can the first and second bearings 48 and 50 be disposed inside of the seal assembly 52 without increasing the size of the compressor, but also these bearings can be lubricated with the oil mist included in the refrigerant.

In the embodiment mentioned above, although the first and second angular bearings are ball type bearings, other types of angular bearings, such as a tapered roller bearing, may be used.

Finally, it will be understood by those skilled in the art that the foregoing description is of preferred embodiments of the present invention, and that various changes and modifications thereof can be made without departing from the spirit and scope thereof.

We claim:

1. In a scroll type compressor comprising:

a housing;

an immovable and a movable scroll member housed in said housing and each having spiral guide walls engaged with the guide walls of the other so that spaces for taking in a fluid to be compressed are formed therebetween, said movable scroll member being revolved around a center axis of the immovable scroll member in such a manner that, as said spaces are displaced toward centers of said spiral guide walls, the volume thereof is reduced to thereby cause compression of the fluid in said spaces;

a drive shaft provided in said housing for coupling to a suitable drive source; and an eccentric mechanism provided between said drive shaft and said movable scroll member for converting the rotation of said drive shaft into the revolution of said movable scroll member, the improvement comprising, first and second angular bearings provided in said housing for rotatably supporting said drive shaft with said first and second angular bearings being spaced apart from each other along a longitudinal axis of said drive shaft, respectively, remote from and adjacent to said eccentric mechanism, said first and second angular bearing being oriented so that forces to which said first and second angular bearings are subjected due to a force exerted upon said drive shaft in a cantilever manner during compressing operation of the compressor act on the axis of aid drive shaft outside the boundaries of said first and second angular bearings, whereby an increase in load on said second angular bearing due to said cantilever acting force is effectively suppressed.

2. A scroll type compressor as set forth in claim 1, wherein one end of said drive shaft projects from said housing for coupling to said drive source, a seal assembly is provided on said drive shaft to prevent leakage of fluid through a space around said drive shaft, and said first and second angular bearings are disposed inward of said seal assembly.

3. A scroll type compressor as set forth in claim 2, wherein the fluid to be compressed includes a lubricating oil mist, and said first and second angular bearings are lubricated with the oil mist included in said fluid.

4. A scroll type compressor as set forth in claim 1, wherein said drive shaft includes an elongated bar portion and an enlarged portion integrated with one end thereof and supporting an eccentric shaft element which forms a part of said eccentric mechanism; the elongated bar portion of said shaft member being rotatably supported by said first angular bearing, and the enlarged portion of said drive shaft being rotatably supported by said second angular bearing.

* * * * *

UNITED STATES PATENT AND TRADEMARK OFFICE

CERTIFICATE OF CORRECTION

PATENT NO. : 5,120,205

DATED : June 9, 1992

INVENTOR(S) : Takashi Ban et al.

It is certified that error appears in the above-identified patent and that said Letters Patent is hereby corrected as shown below:

Col. 3, line 54, omit the word "the".

Col. 5, line 56, "$_2=(1+\ell_2/\ell_1)F$" should read --$f_2=(1+\ell_2/\ell_1)F$--.

Col. 7, line 6, the word "bearing" should read --bearings--.

Signed and Sealed this

Seventeenth Day of August, 1993

Bruce Lehman

*Attest:*

BRUCE LEHMAN

*Attesting Officer*

*Commissioner of Patents and Trademarks*